US007886711B2

(12) United States Patent
Iwata et al.

(10) Patent No.: US 7,886,711 B2
(45) Date of Patent: Feb. 15, 2011

(54) OIL DRAIN PASSAGE STRUCTURE

(75) Inventors: Yasushi Iwata, Toyota (JP); Tatsuhiro Terada, Toyota (JP)

(73) Assignee: Toyota Jidosha Kabushiki Kaisha, Aichi-Ken (JP)

( * ) Notice: Subject to any disclaimer, the term of this patent is extended or adjusted under 35 U.S.C. 154(b) by 202 days.

(21) Appl. No.: 12/362,801

(22) Filed: Jan. 30, 2009

(65) Prior Publication Data

US 2009/0194062 A1 Aug. 6, 2009

(30) Foreign Application Priority Data

Feb. 1, 2008 (JP) ..... 2008-023177

(51) Int. Cl.
*F01M 11/02* (2006.01)

(52) U.S. Cl. ..... 123/196 R; 123/195 R; 123/195 C; 123/198 DA; 123/90.31; 123/90.33; 184/6.5; 74/608; 74/609

(58) Field of Classification Search ..... 123/195 R, 123/195 C, 196 R, 198 DA; 184/6.5; 74/608, 74/609

See application file for complete search history.

(56) References Cited

U.S. PATENT DOCUMENTS 4,122,818 A * 10/1978 Hattori ..... 123/196 AB
4,607,601 A * 8/1986 Kohler ..... 123/90.31
5,148,784 A * 9/1992 Hiraoka et al. ..... 123/195 C
6,561,156 B2 * 5/2003 Iizuka et al. ..... 123/196 R
6,766,714 B2 * 7/2004 Iwata et al. ..... 74/606 R
6,923,154 B2 * 8/2005 Gschwindt et al. ..... 123/195 C
2007/0277760 A1 * 12/2007 Inaba et al. ..... 123/90.31

FOREIGN PATENT DOCUMENTS

EP 1258615 A2 * 11/2002
JP 03000914 A * 1/1991
JP 05-332118 A 12/1993
JP 08-200089 A 8/1996
JP 08-218835 A 8/1996
JP 08200088 A * 8/1996
JP 08326520 A * 12/1996
JP 09025810 A * 1/1997
JP 10131730 A * 5/1998
JP 2004052629 A * 2/2004
JP 2004-518844 A 6/2004
WO 02/066795 A1 8/2002

* cited by examiner

*Primary Examiner*—Michael Cuff
*Assistant Examiner*—Hung Q Nguyen
(74) *Attorney, Agent, or Firm*—Sughrue Mion, PLLC

(57) ABSTRACT

An oil drain passage that guides, to an oil pan, lubrication oil in a space surrounded by a side wall of an engine block and an inner wall of a chain cover is formed with a partition formed by contacting a rib provided on the inner wall of the chain cover and a rib provided on the side wall of the engine block. An opening is provided in a portion of the partition.

1 Claim, 6 Drawing Sheets

OIL DRAIN PASSAGE STRUCTURE

INCORPORATION BY REFERENCE

The disclosure of Japanese Patent Application No. 2008-023177 filed on Feb. 1, 2008 including the specification, drawings and abstract is incorporated herein by reference in its entirety.

BACKGROUND OF THE INVENTION

1. Field of the Invention

The invention relates to an oil drain passage structure for guiding, to an oil pan, lubrication oil in a space surrounded by a side wall of an engine block on the side on which a timing chain is arranged and by an inner wall of a chain cover that covers the timing chain.

2. Description of the Related Art

The rotation of a crankshaft of an internal combustion engine is transmitted to a camshaft by means of a timing chain. This timing chain is typically covered by a chain cover. Lubrication oil for lubricating the timing chain and lubrication oil discharged from a hydraulic tensioner for adjusting the tension of the timing chain are dispersed within a space surrounded by a side wall of an engine block on the side on which the timing chain is arranged and an inner wall of the chain cover, namely on the inner wall of the chain cover. In addition, lubrication oil that has passed through a cylinder head is discharged to the inside of the chain cover.

When lubrication oil within this chain cover contacts the timing chain while it is rotating or accumulates on a wall surface of the chain cover, air bubbles easily enter the lubrication oil as a result of the lubrication oil being agitated, thereby resulting in the risk of, for example, a decrease in hydraulic pressure of the lubrication system or an inadequate supply of lubrication oil.

For example, Japanese Patent Application Publication No. 8-200089 (JP-A-8-200089) describes that a rib formed on an inner wall of a chain cover is used as a partition, and an oil drain passage is formed by providing the partition extending towards the bottom of an engine block, thereby enabling lubrication oil within the chain cover to be guided towards an oil pan via this oil drain passage.

In the case of forming an oil drain passage in the manner described above, lubrication oil flowing over the inside of the partition that forms the oil drain passage is suitably returned to the oil pan. However, lubrication oil flowing over the outside of the partition that forms the oil drain passage is not returned to the oil pan, but rather ends up accumulating on the wall surface of the chain cover, thereby resulting in susceptibility to the formation of air bubbles.

SUMMARY OF THE INVENTION

This invention provides an oil drain structure capable of suppressing the entrance of air bubbles into lubrication oil within a chain cover.

An aspect of the invention relates to an oil drain passage structure that guides, to an oil pan, lubrication oil in a space surrounded by a side wall of an engine block on the side on which a timing chain that transmits the rotation of a crankshaft to a camshaft is arranged, and an inner wall of a chain cover that covers the timing chain. This oil drain passage structure is provided with an opening provided in the partition forming the oil drain passage.

According to this constitution, lubrication oil flowing over the outside of the partition forming the oil drain passage can be drawn inside the partition from the opening, thereby enabling lubrication oil flowing over the outside of the partition to also return to the oil pan. Thus, the entrance of air bubbles into lubrication oil within the chain cover can be suppressed.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

The following provides an explanation of an oil drain passage structure according to an embodiment of the invention with reference to FIGS. 1 to 4.

Figure 1:
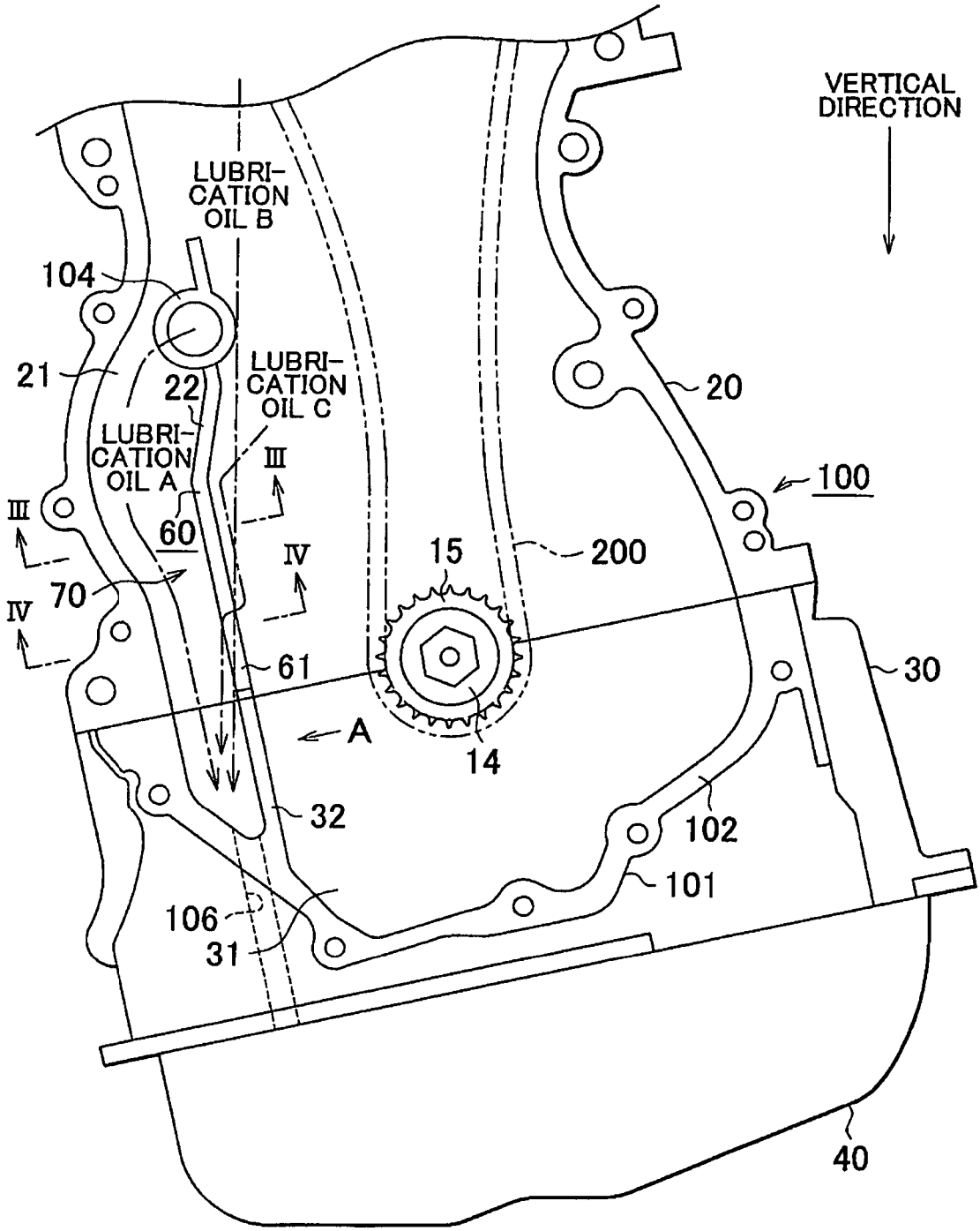
FIG. 1 is a side view of an engine to which is applied an oil drain passage structure according to an embodiment of the invention.

As shown in FIG. 1, this engine is installed in a vehicle on an angle with respect to the vertical direction (direction of gravity). This engine is provided with a cylinder block 20 in which cylinders are formed, a crankcase 30 mounted below the cylinder block 20, an oil pan 40 mounted below the crankcase 30, cylinder heads mounted above the cylinder block 20, and head covers mounted above the cylinder heads. The engine block 100 is composed of the cylinder block 20, the crankcase 30 and the cylinder heads.

A sprocket 15 is mounted on a crankshaft 14 of this engine, and a timing chain 200 (indicated with double-dot broken lines) is engaged with this sprocket 15. The rotation of the crankshaft 14 is transmitted to a camshaft by this timing chain 200. Furthermore, in a conventional technology, the timing chain 200 is lubricated with an engine lubrication oil, and the tension of the timing chain 200 is adjusted with a hydraulic tensioner.

A joining surface 102 for joining with a chain cover that covers the timing chain 200 is formed on an outer peripheral portion 101 of the engine block 100. In addition, a discharge port 104 through which lubrication oil that has passed through the cylinder heads is discharged is formed in a side wall of the engine block 100, and more specifically, in a side wall 21 of the cylinder block 20 on the side on which the timing chain 200 is arranged. This discharge port 104 is formed closer to the outer peripheral portion 101 relative to the vicinity of the middle of the cylinder block 200, and protrudes in the shape of a cylinder from the side wall 21.

In addition, a cylinder side rib 22 is provided protruding from the side wall 21 of the cylinder block 20. This cylinder side rib 22 is provided to face the timing chain 200. One end of this cylinder side rib 22 is connected to an outer peripheral surface of the discharge port 104, while the other end extends below the cylinder block 20.

In addition, a crank side rib 32 is provided protruding from a side wall 31 of the crankcase 30 that extends downward by coupling to the other end of the cylinder side rib 22. The lower end of this crank side rib 32 is connected to the outer peripheral portion 101. A communicating port 106 communicating with the oil pan 40 is formed in the vicinity of the connecting site of the lower end of the crank side rib 32 and the outer peripheral portion 101.

Figure 2:
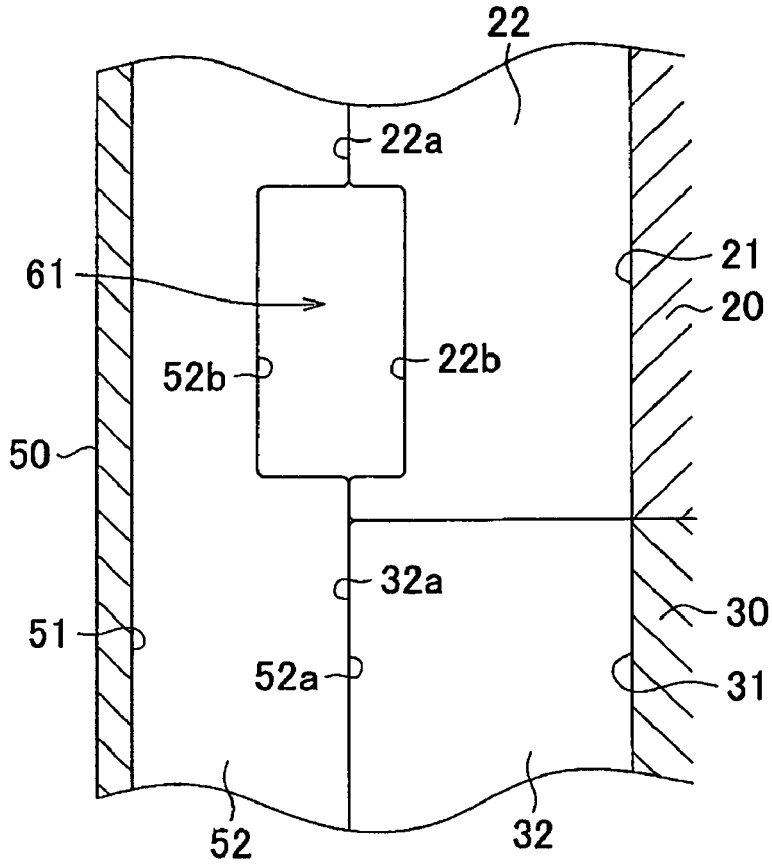
FIG. 2 is a partial cross-sectional view as viewed from the direction of arrow A of FIG. 1.
Figure 3:
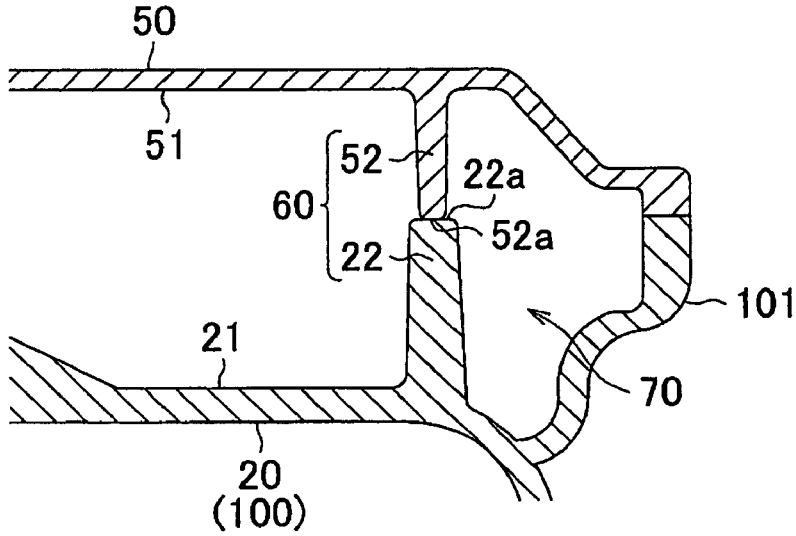
FIG. 3 is a cross-sectional view taken along line III-III of FIG. 1 (cross-sectional view of partition)
Figure 4:
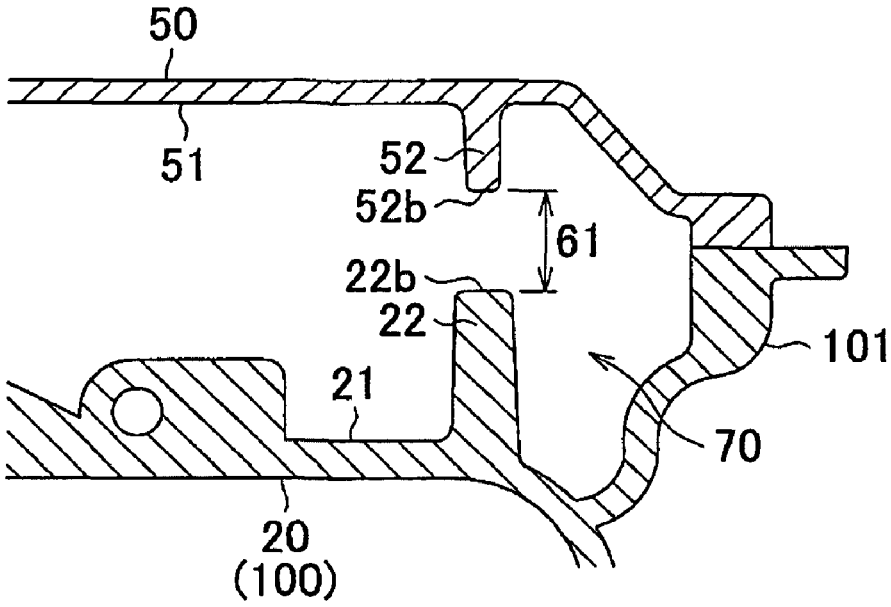
FIG. 4 is a cross-sectional view taken along line IV-IV of FIG. 1 (cross-sectional view of opening)

FIGS. 2 to 4 indicate partial cross-sectional views of the engine block 100 with a chain cover 50 installed therein. Furthermore, FIG. 2 is a drawing as viewed from the direction of arrow A shown in FIG. 1, FIG. 3 is a cross-sectional view taken along line III-III in FIG. 1, and FIG. 4 is a cross-sectional view taken along line IV-IV in FIG. 1.

As shown in FIGS. 2 to 4, a cover side rib 52 is provided protruding from an inner wall 51 of the chain cover 50. This cover side rib 52 extends corresponding to the direction of formation of the cylinder side rib 22 and the crank side rib 32, and basically, as shown in FIGS. 2 and 3, a distal end 52*a* of the cover side rib 52 contacts a distal end 22*a* of the cylinder side rib 22 and a distal end 32*a* of the crank side rib 32. As a result, a partition 60 is formed by the cover side rib 52, the cylinder side rib 22 and the crank side rib 32, and an oil drain passage 70 is formed by this partition 60 for guiding lubrication oil in a space surrounded by a side wall of the engine block 100 and inner wall 51 of the chain cover 50, namely on the inside of the chain cover 50, to the side of the oil pan 40.

In addition, as shown in FIG. 2, an opening 61 is formed in a portion of the partition 60 forming the oil drain passage 70. More specifically, as shown in FIG. 2, a first indentation 22*b* is formed in the cylinder side rib 22 provided on a side wall of the engine block 100, by lowering the height of a portion of the cylinder side rib 22. In addition, a second indentation 52*b* is formed in the cover side rib 52 at a position facing the first indentation 22*b*, by lowering the height of a portion of the cover side rib 52. As a result, portions of the distal end of the cylinder side rib 22 and the distal end of the cover side rib 52 are separated, and the opening 61 is formed at the site of this separation, namely by the first indentation 22*b* and the second indentation 52*b*. In addition, as shown in FIG. 1, the opening 61 is formed at a site where lubrication oil C dropping from an upper portion of the engine block contacts the partition 60, and more particularly, a site where the amount of lubrication oil dropping towards the partition 60 is the greatest.

Next, an explanation is provided of the action and effects according to the previously described constitution with reference to FIG. 1. First, lubrication oil for lubricating the timing chain 200 and lubrication oil discharged from the hydraulic tensioner for adjusting the tension of the timing chain 200 and the like are dispersed on the inside of the chain cover 50, and lubrication oil that has passed through the cylinder head is discharged.

If lubrication oil within the chain cover 50 contacts the timing chain 200 while it is rotating or accumulates on the inner wall 51 of the chain cover 50, air bubbles easily enter as a result of the lubrication oil being agitated, thereby resulting in the risk of, for example, a decrease in hydraulic pressure of the lubrication system or inadequate supply of lubrication oil.

With respect to this point, according to the previously described constitution, lubrication oil flowing over the inside of the partition 60 forming the oil drain passage 70 is returned to the oil pan 40 via the oil drain passage 70 in the manner of lubrication oil A discharged from the discharge port 104.

On the other hand, lubrication oil B flowing over the outside (outer wall) of the partition 60 forming the oil drain passage 70 is returned to the oil pan 40 by being drawn inside the partition 60 from the opening 61. Thus, lubrication oil flowing over the outside of the partition 60 is also returned to the oil pan 40 and a result thereof, entrance of air bubbles into the lubrication oil within the chain cover 50 can be suitably suppressed. Furthermore, since the engine in this embodiment is installed on an angle with respect to the vertical direction, lubrication oil that has dropped down after flowing along the inner wall 51 of the chain cover 50 and the inner wall of the engine block easily reaches the wall surface on the outside of the partition 60. With respect to this point, according to this embodiment, lubrication oil that has reached the wall surface on the outside of the partition 60 in this manner can be suitably returned to the oil pan 40.

In addition, the partition 60 is composed by contacting the cover side rib 52 and engine block ribs (cylinder side rib 22 and crank side rib 32), and in this case, the opening 61 can also be formed by providing holes in the cover side rib 52 and engine block ribs. However, in this case, in the case of integrally forming each rib by casting, there is the risk of the occurrence of problems such as inadequate flow of the melt around the hole or the die becoming excessively complex, and in the case of forming holes by post-processing, there are problems such as an increase in the number of production steps. With respect to this point, in this embodiment, since the opening 61 is formed by separating portions of the cylinder side rib 22 and the cover side rib 52, the opening 61 can be formed easily.

In addition to the lubrication oil B flowing along a wall surface on the outside of the partition 60 forming the oil drain passage 70 as previously described, there is also a lubrication oil C that drops from an upper portion of the engine block 100 towards the partition 60. When the lubrication oil C that has dropped down in this manner is rebounded by the partition 60, the resulting dispersed lubrication oil contacts the timing chain 200 while it is rotating, thereby facilitating the entrance of air bubbles into the lubrication oil. With respect to this point, in this embodiment, the opening 61 is formed at the site of the partition 60 where the lubrication oil C that has dropped down in this manner makes contact therewith. As a result, the lubrication oil C that has dropped from an upper portion of the engine block 100 is not rebounded by the partition 60, but rather is returned to the oil pan 40 by being drawn into the partition 60. Thus, the entrance of air bubbles as described above caused by the lubrication oil C being rebounded by the partition 60 can be suppressed. In this embodiment, since the opening 61 is formed at the site where the amount of lubrication oil dropping from an upper portion of the engine block 100 towards the partition 60 is the greatest, entrance of air bubbles into the lubrication oil can be efficiently suppressed.

As previously explained, the following effects can be obtained according to this embodiment. In the structure of the oil drain passage 70 for guiding, to the oil pan 40, lubrication oil in a space surrounded by a side wall of an engine block on the side on which the timing chain 200 that transmits the rotation of the crankshaft 14 to a camshaft is arranged, and the inner wall 51 of the chain cover 50, the opening 61 is provided in a portion of the partition 60 forming the oil drain passage 70. Consequently, lubrication oil flowing over the outside of the partition 60 forming the oil drain passage 70 can be drawn inside the partition 60 from the opening 61, thereby enabling this lubrication oil to also be returned to the oil pan 40. Thus, the entrance of air bubbles into lubrication oil within the chain cover 50 can be suppressed.

The partition 60 is formed by contacting the cover side rib 52 provided on the inner wall 51 of the chain cover 50 and ribs provided on a side wall of the engine block 100 (cylinder side rib 22 and crank side rib 32). The opening 61 is formed by separating portions of the rib provided on a side wall of the engine block 100 (cylinder side rib 22) and the cover side rib 52. Thus, the opening 61 can be formed easily.

The opening 61 is formed at a site where lubrication oil C dropping from an upper portion of the engine block 100 contacts the partition 60. Consequently, entrance of air bubbles caused by this lubrication oil C being rebounded by the partition 60 can be suppressed.

Figure 5:
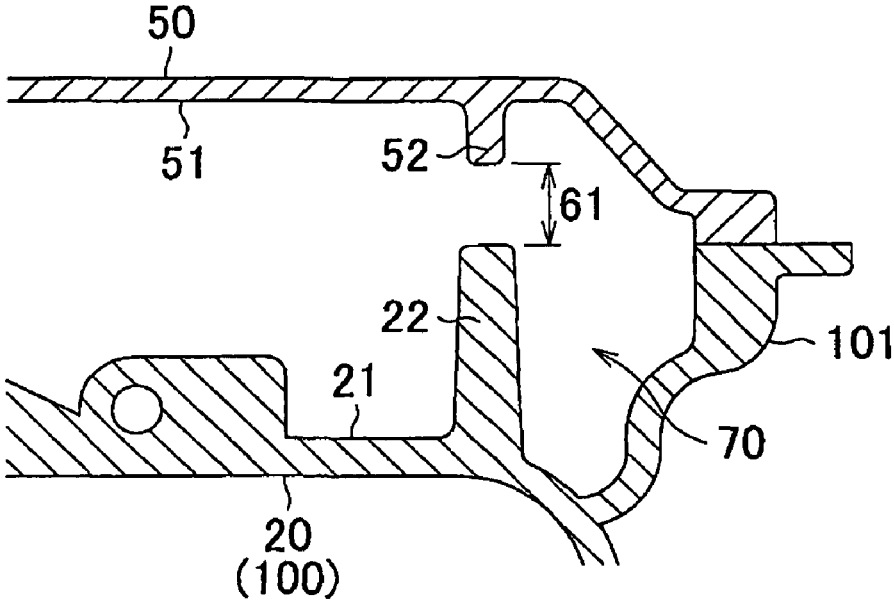
FIG. 5 is a cross-sectional view showing a rib shape of an opening in a first variation of the embodiment.
Figure 6:
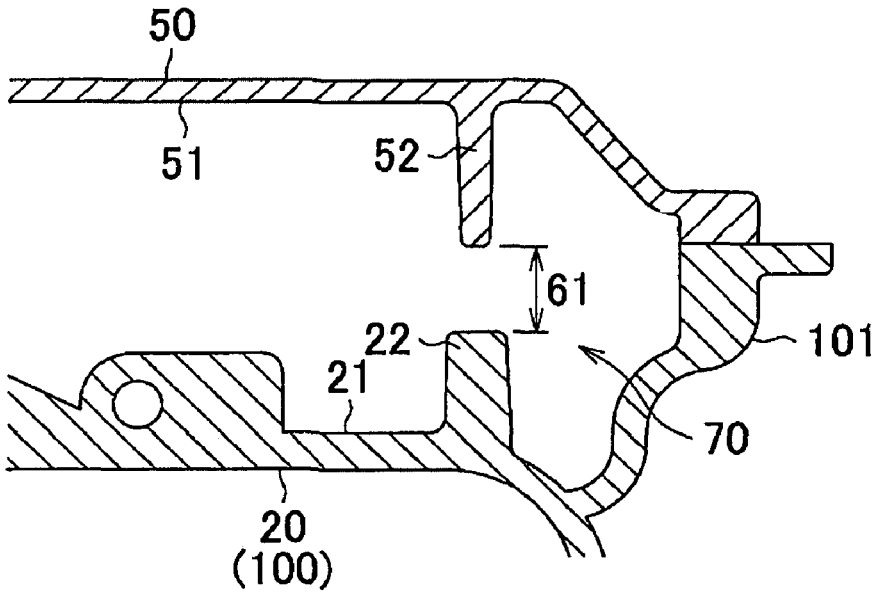
FIG. 6 is a cross-sectional view showing a rib shape of an opening in a second variation of the embodiment.

Furthermore, this embodiment may be modified in the manner described below. According to the above-described embodiment, the opening 61 is formed by lowering the height of a portion of each of the cylinder side rib 22 and the cover side rib 52. However, as shown in FIG. 5, the opening 61 may be formed by lowering the height of a portion of only the cover side rib 52. Alternatively, as shown in FIG. 6, the opening 61 may be formed by lowering the height of a portion of only in the cylinder side rib 22.

Figure 7:
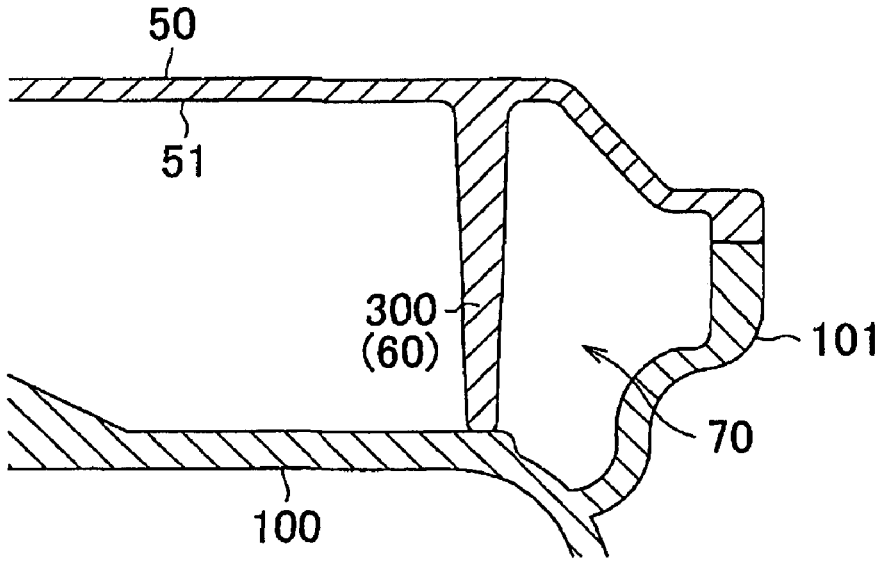
FIG. 7 is a cross-sectional view showing a rib shape of a partition in a third variation of the embodiment.

As shown in FIG. 7, a rib 300 contacted by the distal end of a side wall of the engine block 100 may be provided on the inner wall 51 of the chain cover 50, and the partition 60 may be formed with this rib 300.

Figure 8:
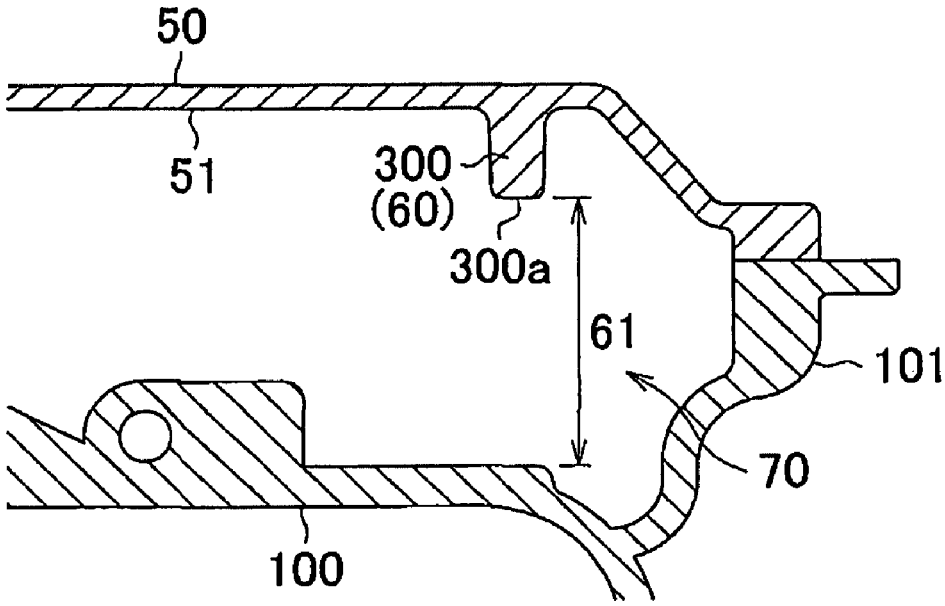
FIG. 8 is a cross-sectional view showing a rib shape of an opening in a third variation of the embodiment.

Furthermore, in this case as well, the opening 61 can be formed in the manner described above by providing a hole in the rib 300. However, in the case of integrally forming the rib 300 by casting, there is the risk of the occurrence of problems such as inadequate flow of the melt around the hole or the die becoming excessively complex, and in the case of forming holes by post-processing, there are problems such as an increase in the number of production steps. Therefore, as shown in FIG. 8, the opening 61 may be formed by forming an indentation 300*a* by lowering the height of a portion of the rib 300, and thereby the portion of the rib 300 is separated from a side wall of the engine block 10. In this case, the opening 61 can be formed easily.

Figure 9:
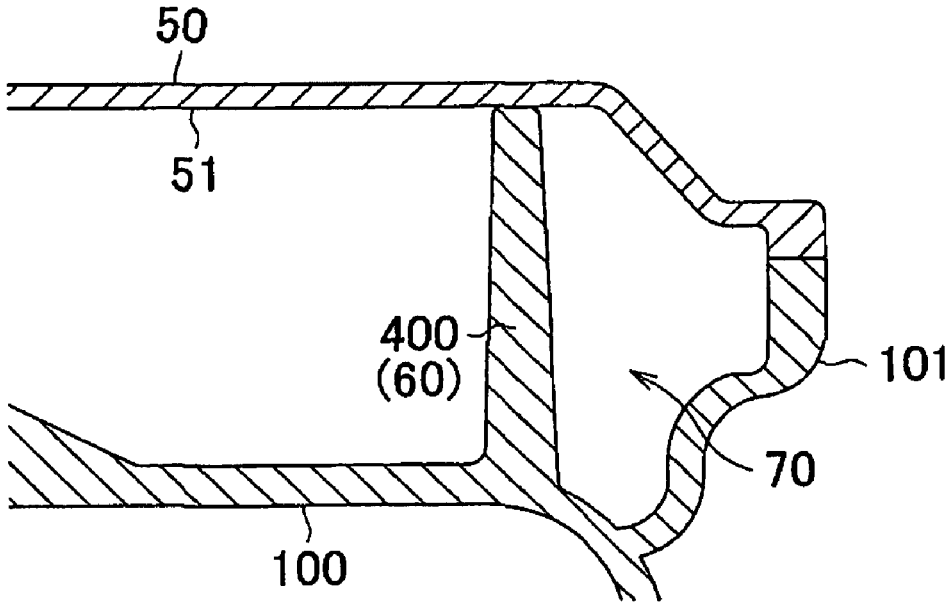
FIG. 9 is a cross-sectional view showing a rib shape of a partition in a fourth variation of the embodiment.

As shown in FIG. 9, a rib 400, the distal end of which contacts the inner wall 51 of the chain cover 50, may be provided on a side wall of the engine block 100, and the partition 60 may be formed with this rib 400.

Figure 10:
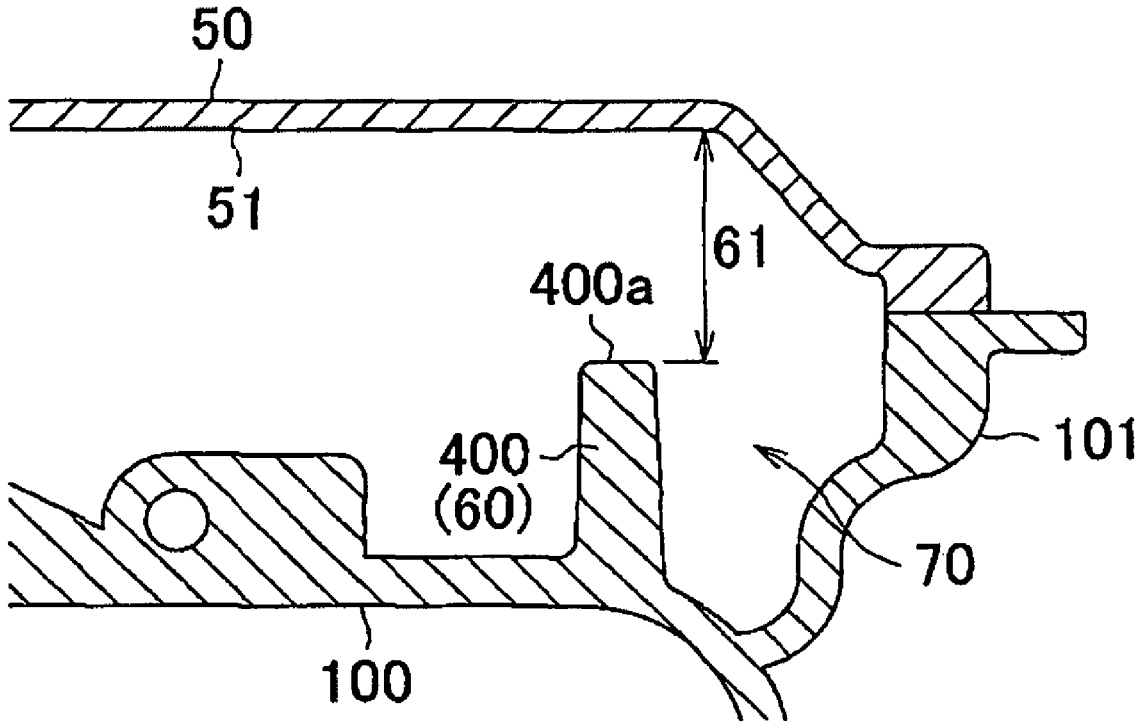
FIG. 10 is a cross-sectional view showing a rib shape of an opening in a fourth variation of the embodiment.

Furthermore, in this case as well, the opening 61 can be formed in the manner described above by providing a hole in the rib 400. However, in the case of integrally forming the rib 400 by casting, there is the risk of the occurrence of problems such as inadequate flow of the melt around the hole or the die becoming excessively complex, and in the case of forming holes by post-processing, there are problems such as an increase in the number of production steps. Therefore, as shown in FIG. 10, the opening 61 may be formed by forming an indentation 400*a* by lowering the height of a portion of the rib 400, and thereby the portion of the rib 400 is separated from the inner wall 51 of the chain cover 50. In this case, the opening 61 can be formed easily.

According to the above-described embodiment, the opening 61 is formed at a portion where lubrication oil dropping from an upper portion of the engine block 100 contacts the partition 60. However, the opening 61 may also be formed at another portion. Furthermore, in the case the portion where the opening 61 is formed reaches to the crank side rib 32, an indentation similar to the first indentation 22*b* is also formed in the crank side rib 32. In addition, the size and shape of the opening 61 may be changed as appropriate. In addition, according to the above-described embodiment, the opening 61 is formed at a single location in the partition 60. However, the opening 61 may also be formed at a plurality of locations in the partition 60.

According to the above-described embodiment, the partition 60 is formed with ribs formed on a side wall of the engine block 100 and on the inner wall 51 of the chain cover 50. However, the partition 60 may be formed by an additional plate-like member attached to a side wall of the engine block 100 and the inner wall 51 of the chain cover 50.

The engine in the previously described embodiment is installed in a vehicle at an angle with respect to the vertical direction. However, this invention can be similarly applied to an engine installed in the vertical direction provided the partition 60 is formed at an angle relative to the vertical direction and lubrication flows over the wall surface on the outside of the partition 60.

What is claimed is:

1. An oil drain structure, characterized in that:

an inner-side space of a chain cover is formed by being surrounded by a side wall of an engine block on a side on which a timing chain that transmits rotation of a crankshaft to a camshaft is arranged, and by an inner wall of the chain cover that covers the timing chain;

there is provided a partition that partitions the inner-side space into an oil drain passage that guides lubrication oil toward an oil pan and a chain arranged space in which the timing chain is arranged;

the partition is formed by bringing a rib provided on the inner wall of the chain cover into contact with a rib provided on the side wall of the engine block; and an opening is formed in a portion of the partition by separating a portion of the rib provided on the side wall of the engine block from a portion of the rib provided on the inner wall of the chain cover.

* * * * *